United States Patent [19]

Weigel et al.

[11] 4,127,408

[45] Nov. 28, 1978

[54] METHOD FOR THE CONTINUOUS REFINEMENT OF CONTAMINATED COPPER IN THE MOLTEN PHASE

[75] Inventors: Horst Weigel; Gerhard Melcher, both of Cologne; Wolfgang Wuth, Berlin, all of Germany

[73] Assignee: Klöckner Humboldt Deutz Aktiengesellschaft, Germany

[21] Appl. No.: 867,600

[22] Filed: Jan. 9, 1978

Related U.S. Application Data

[63] Continuation-in-part of Ser. No. 685,896, May 12, 1976, abandoned.

[30] Foreign Application Priority Data

May 22, 1975 [DE] Fed. Rep. of Germany ..... 2522662

[51] Int. Cl.[2] ..... C22B 15/00

[52] U.S. Cl. ..... 75/76

[58] Field of Search ..... 75/72–76

[56] References Cited

U.S. PATENT DOCUMENTS 3,902,895 9/1975 Wuth ..... 75/76

FOREIGN PATENT DOCUMENTS 1,348,513 3/1974 United Kingdom ..... 75/76

*Primary Examiner*—M. J. Andrews

*Attorney, Agent, or Firm*—Hill, Gross, Simpson, Van Santen, Steadman, Chiara & Simpson

[57] ABSTRACT

A method for continuously refining impurities from a copper melt wherein molten copper is conveyed sequentially through reduction and oxidation zones where it is reacted with gases to free it from impurities. The method involves passing an oxygen containing gas into contact with a molten copper bath in the form of a vertical jet under controlled pressure conditions, controlled velocity, controlled spacing and the like, resulting in a convective material exchange between the copper bath and the gas before the gas is used to oxidize a reducing gas stream.

8 Claims, 2 Drawing Figures

METHOD FOR THE CONTINUOUS REFINEMENT OF CONTAMINATED COPPER IN THE MOLTEN PHASE

REFERENCE TO RELATED APPLICATION

This application is a continuation-in-part of our U.S. Ser. No. 685,896 filed May 12, 1976, now abandoned.

BACKGROUND OF THE INVENTION

1. Field of the Invention

This invention is in the field of continuous refining of contaminated copper in the molten phase and has to do with controlling the conditions of an oxygen containing gas stream in the form of a jet, and directing the same vertically in the form of a confined energy rich stream at the essentially smooth surface of a copper metal bath to produce a torus-type rotating stream under controlled conditions of pressure, velocity, spacing and jet force.

2. Description of the Prior Art

A continuous method for the refining of contaminated copper in the molten phase is described in the German Pat. No. 2,061,388 and its British counterpart, British Pat. No. 1,348,513 published Mar. 20, 1974. In this type of procedure, the molten copper is conveyed into a treatment chamber through several reaction zones in countercurrent contact with hot gases and is thereby freed of impurities. In the last reaction zone, fuel and an oxygen containing first gas are conveyed in less than stoichiometric proportions, thereby producing a reducing heating gas. In the zones prior to the last reaction zone, an after combustion of fuel which is still unburnt in the heating gas is carried out through an additional supply of a second oxygen containing gas. German Pat. No. 2,061,388 and its British counterpart describe an efficient continuous process for the refining of contaminated copper in the molten phase. The disclosure of the corresponding British Pat. No. 1,348,513 is incorporated herein by reference.

Reference is also made to Wuth U.S. Pat. No. 3,902,895. This patent deals with a method for the separation of elements from a liquid metal bath, particularly copper, wherein reaction gases are blown in the form of a gas jet approximately perpendicular to the bath surface and with sufficient force so that the melt rotates essentially like a torus, resulting in a reaction unit with definite material transition, limited by the convection conditions of the system.

In the system shown in the British patent, the continuity of the process can be achieved and maintained only by means of absolutely constant flow densities of material of the liquid and gaseous reaction participants. However, this constant flow was not attainable in the prior art with the known methods of charging of the gas to the metal bath. For example, the gas might be brought in contact with the metal by means of inclined or vertical blowing jets, or by means of lances located under the bath surface. Under these circumstances, however, there is no capability for reproducing material transfer and the maintenance of a definite reaction system with uniformly measurable exact parameters. The reason for this is that with this type of contact system, the reaction depends on a number of incidental and therefore changeable parameters. For example, such elements as depth of immersion, shape and/or alteration of the lance configuration changes the quantity and velocity of the gases. In addition, accidental gas bubble formation as well as uncontrolled spraying may result.

With the blowing technique described in the Wuth patent alone, however, copper refining could not be carried out continuously. The Wuth patent is directed strictly to the achievement of a definite convection flow through special conditions of blowing.

SUMMARY OF THE INVENTION

This invention now provides a strictly continuous quantitive and qualitative carrying out of oxidation and/or reduction of the melt, according to a constant and fixed reduction potential under conditions which are readily reproducible. With the system of the present invention, constant densities of flow material are provided to the gaseous and liquid reaction participants existing at the phase interfaces.

Specially, the system of the present invention involves blowing an oxygen containing gas substantially vertically in the form of a confined energy rich stream at the surface of the metal bath to produce a torus-type rotating stream at a pressure between 10 and 20 kp (kiloponds)/cm$^2$ through an acceleration nozzle with a velocity between 1 Mach and 3 Mach, at a distance of less than 1 meter, with a jet force of 5 to 25 Newtons so that a definite convective system results having a dimension perpendicular to the jet dimension of approximately 0.34 to 0.85 meters, and a depth usually about ½ of the perpendicular dimension.

BRIEF DESCRIPTION OF THE DRAWINGS

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure, and in which.

DESCRIPTION OF THE PREFERRED EMBODIMENTS

Figure 1:
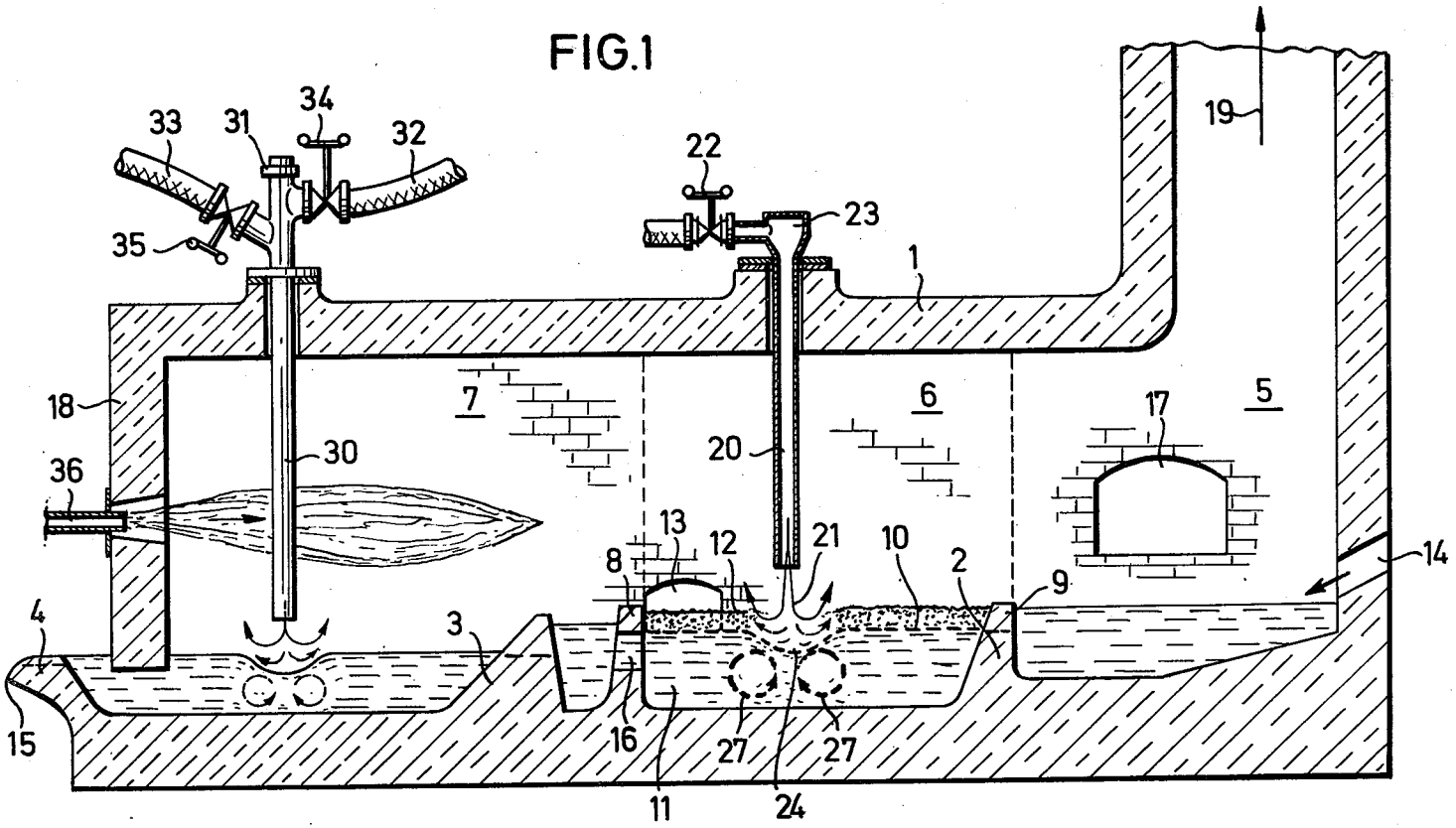
FIG. 1 shows a refining furnace for carrying out the method of the present invention, the showing being in cross-section.

In FIG. 1, there is shown a rectangular smelting furnace 1 which is divided by separating walls 2, 3 and 4 into three tank-shaped reaction zones 5, 6 and 7. In the separating wall 2 there is disposed a flow-through channel or groove 9 for molten copper. In the reaction zone 6 there is shown a bath level 10 below which there is a liquid copper bath 11 and above which there is a slag layer 12. An opening 13 in the furnace wall serves for the withdrawal of the slag 12 from the oxidizing refining-reaction zone 6. The copper is introduced in liquid form through an inlet 14 and leaves the furnace 1 at an exit 15 after being purified. A threshold 8 is provided at the outlet end of the reaction zone for holding back the slag. The liquid copper passes by this threshold 8 through a passage 16 provided under the bath level 10. A closeable opening 17 in the furnace wall of the reaction zone 5 provides means for inspection as well as for feeding solids, for example, copper ore concentrate and/or fuel. The exhaust gas leaves the furnace 1 through a flue 19. A burner 36 is arranged on a front wall 18 of the discharge side.

Figure 2:
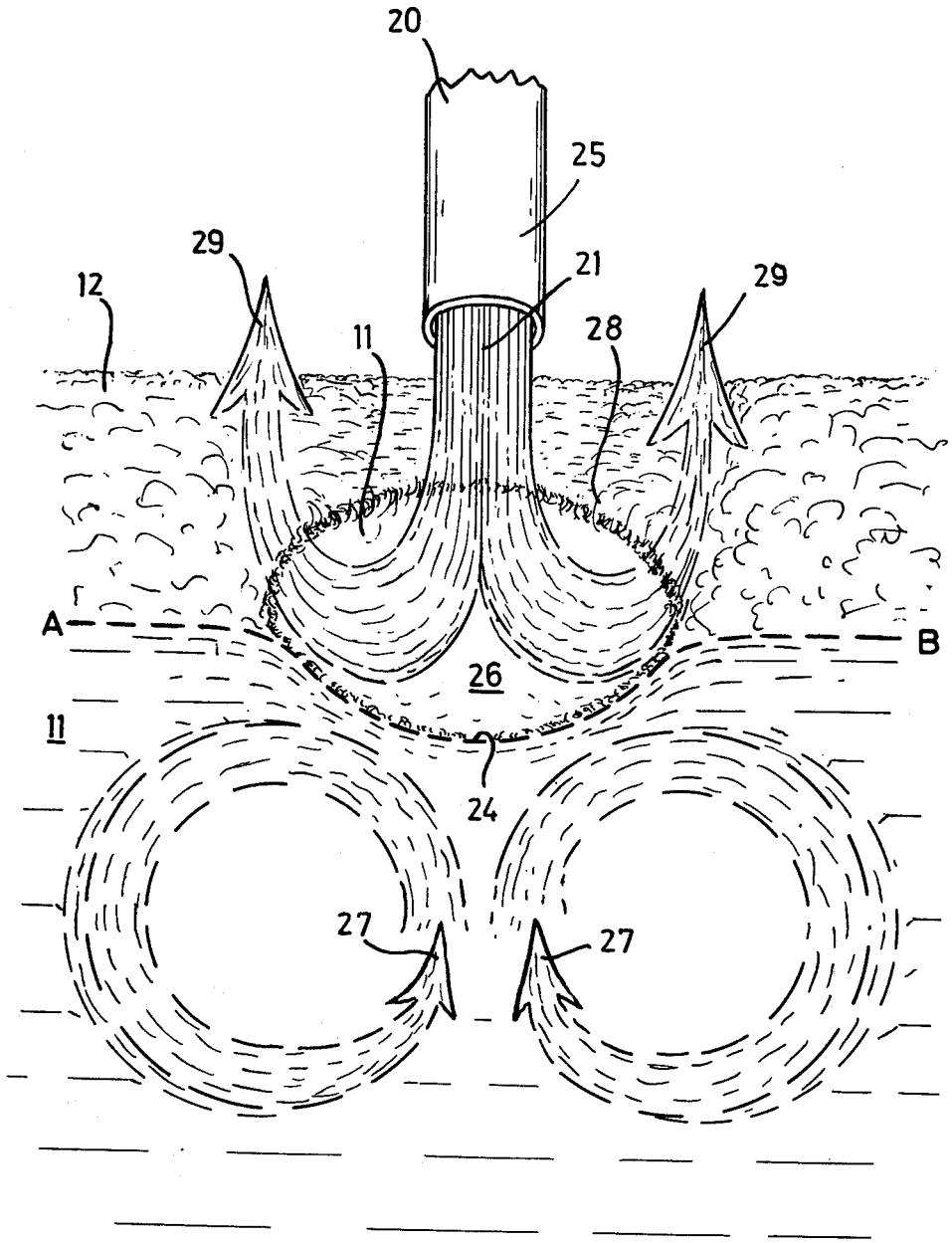
FIG. 2 illustrates the mouth of a jet nozzle with an issuing stream of gas directed on the copper smelting bath, together with a slag layer, the showing being in perspective.

In operation, liquid raw copper is supplied to the furnace 1 at the inlet 14 and/or copper ore concentrate and fuel at the inlet 17. In the zone 5, the material is heated to a treatment temperature appropriate for the subsequent refining. In the zone 6, a nozzle lance 20 serves to conduct oxygen containing reaction gas as a high energy stream onto the bath surface 10 of the relatively quiescent molten copper bath 11. To regulate the blower force and thereby the jet energy, there is a throttle valve 22 provided on a head 23 of the nozzle lance 20. The jet stream issuing from the nozzle lance 20 provides a blowing penetration into the surface 10 of the copper bath 11. This blower penetration 24 has the shape of a concave dish. At its edges, the pressure of the deflected stream of gas 21 moves the slag layer 12 away from the molten bath 11 of copper. This phenomenon is illustrated enlarged in the drawing of FIG. 2 and represents actual visual observations.

It should be noted that the mouth 25 of the nozzle lance 20 from which the gas stream 21 issues encounters the layer 12 of slag above the molten bath 11 with great energy. In the deflection area 26, the layer of slag 12 is forced back and it forms on the smooth surface of the molten bath 11 an "eye" 28 into which there is a dish-shaped concave recess 24 indicated by the dashed line A–B in the molten bath of metal 11. The deflected gas flows back as illustrated by arrows 29 into the surrounding chamber. The high velocity of the gas stream 21 resulting in the concave recess 24 in the melt 11 provides a vigorous bath turbulence in the form of a torus-like flow zone indicated by flow direction vectors 27.

In FIG. 1 there is provided a further nozzle lance 30 in reaction chamber 7 for blowing in reaction gas onto the copper bath. This nozzle lance 30 has on its head two attachments 32 and 33, one of which provides a carrier gas, and the other provides a fuel such as Diesel oil, natural gas, propane, coaldust and the like. Throttle valves 34 and 35 serve for the adjustment of the pressure and thereby control the energy and flow density of the stream of gas.

Experimental results have shown that the parameters involved in the refining operation should be controlled if the best results are to be achieved. Consequently, the nozzle lance 20 should be operated under the following conditions. The torus-type rotating stream 27 has a pressure between 10 and 20 kp/cm$^2$. It is produced by means of a nozzle having a gas speed between 1 Mach and 3 Mach, preferably at 2 Mach. The distance of the nozzle 20 from the surface of the bath is less than 1 meter, and is preferably less than 0.35 meters. The resulting jet force is between 5 and 25 Newtons and preferably lies between 10 and 15 Newtons. The jet impinges on the molten bath without significant spraying.

These conditions result in a definite convection system whose dimensions perpendicular to the jet direction are about 0.34 to 0.85 meters, and preferably about 0.51 meter. The depth of the system is significantly less than the perpendicular dimension, and usually amounts to approximately ½ thereof. A typical depth in a copper refining bath would be about 0.25 meter.

In summary, the method of the present invention provides for the continuous refining of impurities from a copper melt wherein the molten copper is conveyed sequentially through reduction and oxidation zones where it is reacted with gases to free it from the impurities. Fuel and a first oxygen containing gas are passed in countercurrent relationship to the flow of molten copper in the reduction zone, with the oxygen being present in less than stoichimetric quantities, thereby producing a hot reducing gas. The still unburnt fuel is passed to the oxidation zone where it is reacted with a second oxygen containing gas which has first been brought into contact with molten copper as a reactive stream before it contacts the still unburnt fuel. The present invention provides specific reaction conditions under which the most efficient refining of the molten copper mass occurs.

It will be evident that various modifications can be made to the described embodiments without departing from the scope of the present invention.

We claim as our invention:

1. In a method for continuously refining impurities from a copper melt, wherein molten copper is conveyed sequentially through reduction and oxidation zones where it is reacted with gases to free it from impurities, and wherein fuel and a first oxygen containing gas are passed in countercurrent relationship to the flow of molten copper in said reduction zone, said oxygen being present in less than stoichiometric quantities thereby producing a hot reducing gas, the still unburnt fuel being passed to said oxidation zone where it is reacted with a second oxygen containing gas, said second oxygen containing gas being first brought into contact with said molten copper as a reactive stream before it contacts said still unburnt fuel, the improvement which comprises:

blowing said second oxygen containing gases substantially vertically in the form of a confined energy-rich stream at the essentially smooth surface of the metal bath to produce a torus-type rotating stream at a pressure between 10 and 20 kp/cm$^2$ through an acceleration nozzle with a velocity between 1 Mach and 3 Mach, at a distance of less than 1 meter, with a jet force of from 5 to 25 Newtons such that a definite convective system results having a dimension perpendicular to the jet direction of approximately 0.34 to 0.85 meter, and a depth substantially less than said perpendicular dimension.

2. The method of claim 1 in which said depth is approximately ½ of said perpendicular dimension.

3. The method of claim 1 in which said depth is approximately 0.25 meter.

4. The method of claim 1 in which said velocity is approximately 2 Mach.

5. The method of claim 1 in which said distance is approximately 0.35 meter.

6. The method of claim 1 in which said jet force is between 10 and 15 Newtons.

7. The method of claim 1 in which said perpendicular dimension is approximately 0.51 meter.

8. The method of claim 1 in which said jet force is insufficient to cause spraying of said metal bath.

* * * * *